US005538400A

United States Patent [19]

Konishi et al.

[11] Patent Number: 5,538,400

[45] Date of Patent: Jul. 23, 1996

[54] VARIABLE DISPLACEMENT PUMP

[75] Inventors: Hideo Konishi; Tadaaki Fujii, both of Saitama, Japan

[73] Assignee: Jidosha Kiki Co., Ltd., Tokyo, Japan

[21] Appl. No.: 174,039

[22] Filed: Dec. 28, 1993

[30] Foreign Application Priority Data

Dec. 28, 1992 [JP] Japan ..... 4-358801
Feb. 12, 1993 [JP] Japan ..... 5-046171

[51] Int. Cl.[6] ..... F04B 49/00

[52] U.S. Cl. ..... 417/220; 418/26

[58] Field of Search ..... 417/213, 218, 417/219, 220, 310, 307; 418/26, 30, 82, 268

[56] References Cited

U.S. PATENT DOCUMENTS

| | | | |
|---|---|---|---|
| 2,628,567 | 2/1953 | De Lawcey et al. | 418/26 |
| 2,635,551 | 4/1953 | De Lawcey | 417/220 |
| 2,811,926 | 11/1957 | Robinson | 418/26 |
| 2,878,756 | 3/1959 | O'Connor et al. | 418/26 |
| 2,975,717 | 3/1961 | Rynders et al. | 418/26 |
| 3,272,139 | 9/1966 | Rosaen | 418/82 |
| 3,656,869 | 4/1972 | Leonard | 417/220 |
| 4,035,105 | 7/1977 | Dantlgraber | 418/26 |
| 4,342,545 | 8/1982 | Schuster | 418/30 |
| 4,431,389 | 2/1984 | Johnson | 418/268 |
| 4,496,288 | 1/1985 | Nakamura et al. | 418/30 |
| 4,632,638 | 12/1986 | Shibayama et al. | 417/220 |
| 4,678,412 | 7/1987 | Dantlgraber | 417/220 |
| 4,681,517 | 7/1987 | Schulz et al. | 417/310 |
| 5,090,881 | 2/1992 | Suzuki et al. | 418/26 |
| 5,098,259 | 3/1992 | Ohtaki et al. | 417/310 |
| 5,226,802 | 7/1993 | Nakamura et al. | 417/310 |
| 5,266,018 | 11/1993 | Niemiec | 418/268 |
| 5,290,155 | 3/1994 | Snow et al. | 418/82 |

FOREIGN PATENT DOCUMENTS

| | | | |
|---|---|---|---|
| 3322549 | 3/1984 | Germany | 418/30 |
| 53-130505 | 11/1978 | Japan . | |
| 53-140605 | 12/1978 | Japan . | |
| 56-143383 | 11/1981 | Japan . | |
| 58-93978 | 6/1983 | Japan . | |
| 58-170870 | 10/1983 | Japan . | |
| 63-14078 | 4/1988 | Japan . | |
| 5-223064 | 8/1993 | Japan . | |

*Primary Examiner*—Peter Korytnyk
*Attorney, Agent, or Firm*—Sughrue, Mion, Zinn, Macpeak & Seas

[57] ABSTRACT

A variable capacity or displacement type pump by which a pump discharge quantity is variably controlled in accordance with the revolution number, which has simple construction to contributes easier machining and assembling, and is reliable in operation. A cam ring is movably arranged to define a pump chamber around a rotatable rotor within a pump body and is biased so that the volume of the pump chamber is made maximum. Sealing members are provided in an annular space between the cam ring and the pump body so as to define first and second hydraulic pressure chambers through which the cam ring is driven to move. A switch valve is provided to control the hydraulic pressure transmitted to the first and second chambers in accordance with the quantity of the flow discharged from the pump chamber.

7 Claims, 15 Drawing Sheets

VARIABLE DISPLACEMENT PUMP

BACKGROUND OF THE INVENTION

The present invention relates to a vane-type variable displacement pump suitable for use with a pressurized fluid utilizing equipment such as a power steering unit reducing operating force of an automotive handle.

A constant capacity type vane pump, which is directly driven by an automotive engine, is generally used as a pump for the power steering unit. However, the constant capacity type pump has an inherent feature that the quantity of flow discharged from the pump is increased in proportion to the increase of the revolution number of the engine, contrary to the demand wherein the power steering unit produces a large assisting force when the vehicle stops or runs at a lower speed, and a small assisting force when the vehicles runs at a high speed, in view of the running stability and steering feeling.

Thus, the conventional constant capacity type pump is arranged to have a sufficiently large pump chamber to produce a predetermined power assisting force in a low revolution number area and is further provided with a flow control valve through which a part of or most of the discharged flow is released to a tank side in a high revolution area. With such arrangement and by the virtue of the flow control valve, the constant capacity type pump can maintain the quantity of flow supplied to the power steering unit at a constant valve regardless of the revolution number of the pump or can control the quantity of flow supplied to the power steering unit at the low revolution area smaller than that in the high revolution area.

This constant capacity type, however, suffers from a problem in that the flow control valve is indispensable for controlling the pump discharge flow quantity less than a constant quantity, which results in the increase of the components parts for constituting the necessary pump construction. Further, the conduit or passage arrangement is made complicated, to unavoidably increase the size of the pump and the production cost therefor.

Furthermore, the quantity of wasteful flow released from the pump discharge side to the tank side through the flow control valve without being transmitted to the power steering unit is increased as the revolution number of the pump is increased, to increase the wasteful drive force and to deteriorate the energy converting efficiency. That is to say, loss of energy is increased as the engine rotates at the higher revolution number and produces the higher pressure, for example, when the vehicle runs at high speed or comes up a slope.

Moreover, releasing the pump discharge side fluid to the tank side through the above-mentioned flow control valve causes the temperature increase, which results, in some case, in the change of the steering characteristic, the lowering of the pump volume efficiency due to the internal leakage, the seizing of the rotor and the cam ring, the adverse effect onto the sealing members or the like. Therefore, a cooling means such as cooling pipe must be provided for some kind of vehicles, which causes further increase in the production cost.

For these reasons, as a hydraulic or oil pressure pump used for a power steering unit, prior art proposes, in place of the constant capacity type pump, the use of a variable capacity or displacement type pump wherein the pump discharge side flow quantity is changed to decrease in a step like manner as the revolution number increases. Such variable capacity type pump is disclosed, for instance, in Japanese Patent Kokai Publications Sho. 53-130505 and Sho. 56-143383. The proposed variable capacity type pump dispenses with the flow control valve and prevents the increase of the lost drive force to improve the energy efficiency. Moreover, since there is no released flow to the tank side, it is possible to solve the conventional problem in that the fluid temperature is increased due to the released flow. Thus, the variable capacity type pump is also advantageous over the constant capacity type pump in preventing the problem of the internal leakage of the pump, lowering the volume efficiency and so on.

Hereinafter, the variable capacity or displacement type pumps proposed by the publications are described.

The variable displacement type pump disclosed in Japanese Publication No. Sho. 53-130505 is constructed such that an eccentric amount between a center of a rotor of a vane pump and a center of a hollow cam surface to which the vanes are slid is made variable, and further a communication area of a variable orifice provided in a pump discharge side conduit is designed to be decreased as the eccentric amount of the cam ring having the hollow cam surface is decreased. With such construction, the movement of the cam ring is controlled utilizing a pressure difference between the front and the rear of the variable orifice, to thereby decrease the discharge flow quantity in association with the increase of the rotor revolution number.

The variable displacement type pump disclosed in Japanese Publication No. Sho. 56-143383 is constructed such that a cam ring is made movable within a pump casing, and a pair of control chambers are formed in a space between the cam ring and the casing. Pressures in front and rear portions of an orifice provided in a discharge passage are transmitted to the respective control chambers, to effectuate the pressure difference directly on the cam ring to move the cam ring against a biasing force of a spring, whereby the volume of a pump chamber is varied to perform the discharge flow quantity control.

However, since the cam ring is simply held within the pump housing so as to be movable linearly, and is driven to be moved by the pressure difference between the front and rear portions of the orifice provided directly or indirectly on the discharge passage, these variable displacement type pumps still raise problems not only in machining and assembling properties but also in operational reliability and durability. Thus, the practical applicability is poor in use.

Japanese Patent Kokai Publication Sho. 58-93978 and Japanese Utility Model Kokoku Publication Sho 63-14078 also disclose a variable displacement type pump wherein a cam ring is disposed within a pump housing to be linearly movable in a radial direction thereof, a rotor is rotatably accommodated within the cam ring to form a pump chamber therebetween, and the cam ring is driven to be moved relative to the rotor by the pressure difference between front and rear portions of an orifice provided in a pump discharge passage. In the pump, the flow passage area of the orifice is made variable in accordance with the amount of the eccentric displacement of the cam ring relative to the rotor to obtain a desired quantity of discharge flow.

This type of pump, in particular that disclosed in Publication 078 is constructed such that a control pin having a small diameter portion is interposed between an inner wall of the pump housing and an outer periphery of the cam ring movable within the pump housing, and a variable orifice is formed by the combination of the small diameter portion of the control pin and the control surface of the cam ring outer periphery. By forming the orifice such that the pressures in front of and behind this orifice are applied onto the cam ring to displace the cam ring, and the opening area of this orifice is made decreased in association with the decrease of the eccentric displacement of the cam ring, a desired quantity of discharge flow is obtained.

However, in the conventional arrangements, the orifice construction provided in a portion of the pump discharge passage for moving the cam ring is made complicated, and it is difficult to provide sufficient machining accuracy in each portion. Thus, these conventional arrangements also raise problems in machining and assembling, and are still insufficient in operational reliability of variable orifice portion.

That is to say, in the conventional arrangements mentioned above, the variable orifice for moving the cam ring is merely provided on a portion of the pump discharge side passage. It is impossible for this construction to produce a large pressure difference between the front and rear portions of the variable orifice to obtain sufficient pressure difference for enabling the movement of the cam ring within the pump housing. Consequently, the cam ring can not be expected to be moved to present a desired state in accordance with the pump revolution number. Thus, the variable capacity type pump as disclosed has a possibility that it does not surely perform the desired function of a variable capacity type pump.

In particular, in the above-noted conventional arrangements, if dust or the like enters an operation oil which is a control fluid, or a pump housing is deformed under a high pressure, operation performance where the cam ring is moved by the front and rear pressures of the orifice is like to become unstable. More specifically, the cam ring forms at its side face only a slight clearance in order to prevent internal leakage as well known, so that the increase of the sliding resistance due to the clogging of the dust hinders smooth displacing motion. Thus, there is a possibility that a desired flow control can not be obtained.

If the pressure difference between the front and rear of the orifice is set greater in order to conquer such resistance, it is impossible to obtain a low-consumption feature applicable to the power steering unit with sufficient performance, which is a primary objective of the variable displacement type pump. Therefore, some means attempting to solve this problem has been required in the art.

Further, according to the above-noted arrangement, in case where the movable cam ring is fixingly retained within the pump body so as not to slide any more or is fixingly caught at any position, the increase of the pump revolution number results in the increase of the quantity of the pump discharge flow in proportion thereto (See FIG. 11B).

In such case, the large quantity is discharged to the power cylinder side to suddenly lighten the operation feeling of the steering handle. In particular, under a high speed or high revolution number condition, this phenomenon is severe, and is likely to raise a problem in safety. Some means for solving this problem has also been required in the art.

SUMMARY OF THE INVENTION

The present invention was made in order to solve these problems found in the conventional variable displacement type pump arrangements.

Accordingly, a primary objective of the present invention is to provide a variable capacity or displacement type pump, in which a cam ring is arranged to be movable freely to vary the quantity of the flow discharged from the pump correspondingly to the pump revolution number, and the cam ring is surely and appropriately driven to be moved in accordance with the change in flow at the pump discharge side to obtain a desired discharge flow quantity, which is simple in construction, superior in assembling and machining, and reliable in operation, which makes it possible to reduce the production cost, and the entire size of which can be made compact.

In order to attain the above-noted and other objectives, the present invention provides a variable displacement type pump, which includes: a pump body; a rotor having a plurality of vanes, rotatively arranged within the pump body; a cam ring movably arranged around the rotor within the pump body for defining a variable pump chamber between the cam ring and the rotor and an annular chamber between the cam ring and the pump body; biasing means for biasing the cam ring so as to make the pump chamber maximum in volume; sealing means contacting with both the cam ring and the pump body for dividing the annular chamber into first and second hydraulic pressure chambers to which hydraulic pressure is applied to move and position the cam ring relative to the pump body against the biasing force of the biasing means to vary the volume of the pump chamber; and a switch valve driven depending on quantity of fluid discharged from the pump chamber for controlling the hydraulic pressure applied to the first and second hydraulic pressure chambers.

Preferably, the rotor is formed with slit grooves for extendably accommodating respective vanes therein, each of the slit grooves having a proximal portion which is operatively communicated with the pump chamber so as to apply substantially the same pressure as that of the pump chamber onto each of the vanes. The pump may further include: a flow control valve for maintaining the quantity of fluid discharged from the pump chamber at a predetermined constant quantity, the flow control valve being prevented from being activated under a condition wherein the quantity of fluid discharged from the pump chamber is less than the predetermined constant quantity. Preferably, the switch valve presents a condition wherein both the first and second hydraulic pressure chambers are communicated with one of a pump intake side and a pump discharge side.

The present invention further provides a variable displacement type pump which forces fluid to flow from a pump intake side to a pump discharge side, which includes: a pump body; a rotor rotatively arranged in the pump body for defining, together with an inner wall of the pump body, a pump chamber through which the fluid flows from the pump intake side to the pump discharge side, the rotor having a plurality of vanes extendably accommodated in respective slit grooves extending radially in the rotor, each of the slits groove having a distal portion located at the pump chamber and a proximal portion radially opposite from the distal portion; and a plurality of arcuate grooves formed in the inner wall of the pump body and radially located correspondingly to the distal portion with respect to the rotor for operatively communicating the distal portion with one of the pump discharge side and the pump intake side in conjunction with rotation of the rotor.

The present invention further provides a variable displacement type pump which forces fluid to flow from a pump intake side to a pump discharge side, which includes: a pump body; a rotor having a plurality of vanes, rotatively arranged in the pump body; a cam ring movably arranged around the rotor within the pump body for defining a variable pump chamber between the cam ring and the rotor, wherein the fluid flows from the pump intake side to the pump discharge side through the pump chamber; and a flow quantity control valve for fail-safety, which is provided on a midway of a conduit extending from the pump chamber to the pump discharge side, wherein the flow quantity control valve is activated when the pump chamber discharges the fluid at a predetermined quantity slightly higher than an allowable maximum quantity of the pump.

DETAILED DESCRIPTION OF THE PREFERRED EMBODIMENTS

Preferred embodiments of the present invention will now be described in detail with reference to the accompanying drawings attached hereto.

Figure 1:
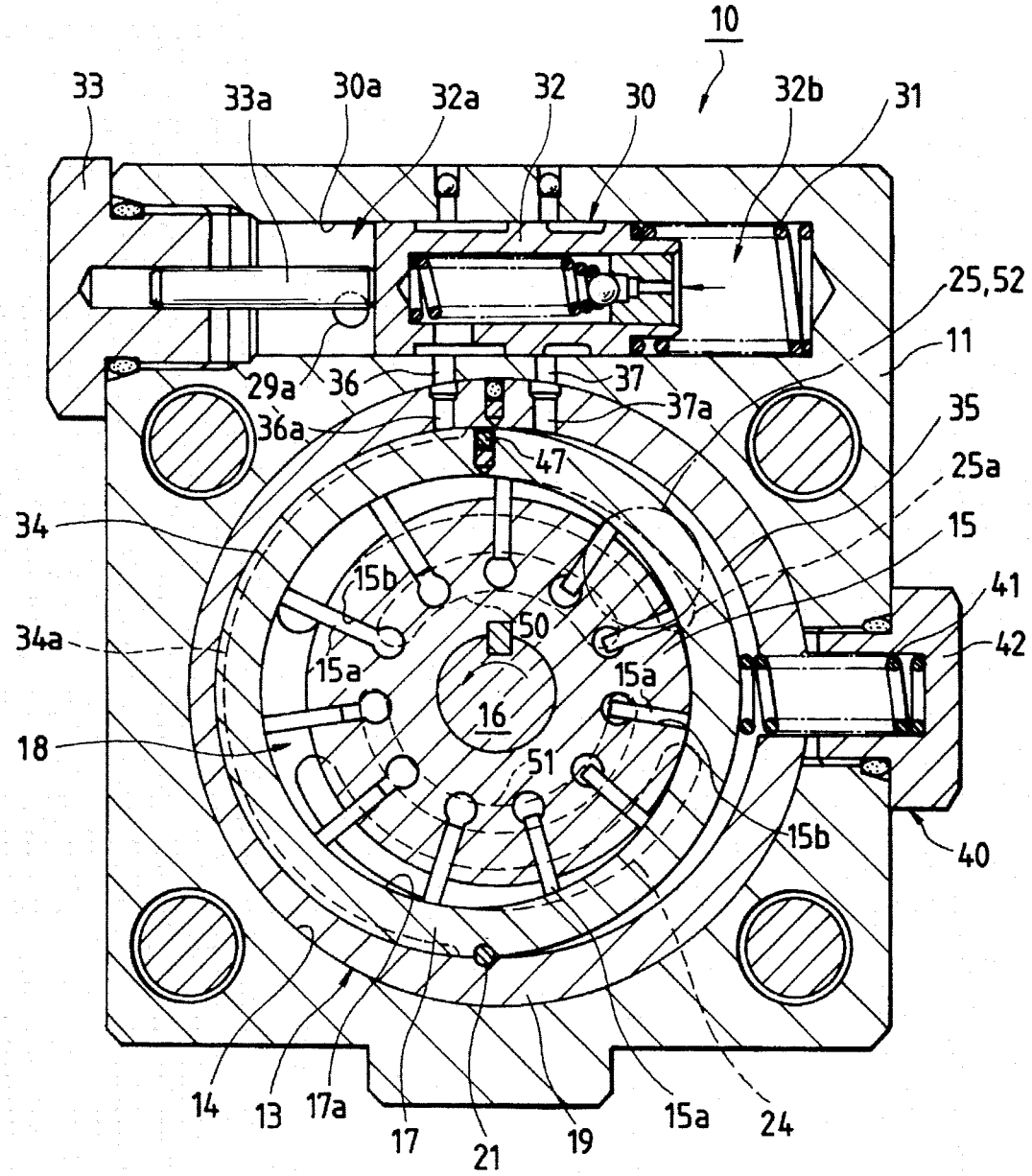
FIG. 1 is a transversely-sectional schematic view showing a major construction of a variable displacement type pump according to a first embodiment of the present invention.
Figure 2:
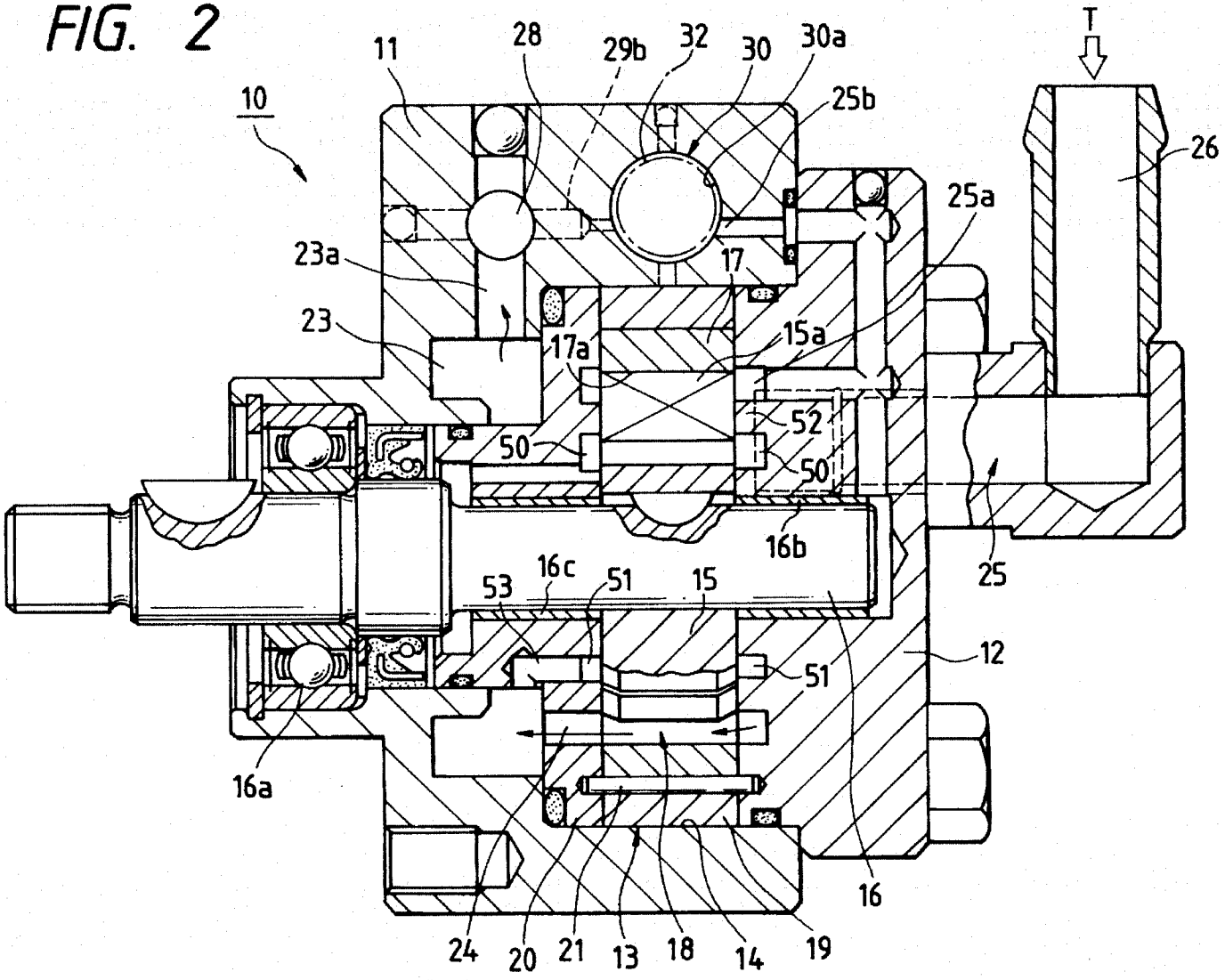
FIG. 2 is a longitudinally sectional view showing major parts for explaining the major construction of FIG. 1.

FIGS. 1 to 5 show an embodiment of a variable displacement pump according to the present invention. The embodiment is described as a vane or blade type oil pump which constitutes a hydraulic pressure generation source for a power steering unit. As best shown in FIGS. 1 and 2, a variable displacement pump, the entire construction of which is designated by a reference numeral 10, includes a front body 11 and a rear body 12 which constitute a pump body. The front body 11 presents a substantially cup-like form entirely. A pump element 13 is disposed and accommodated in an accommodating space 14 defined inside the front body 11. The rear body 12 is coupled to the front body 11 to close an open end of the accommodating space 14 and to form a unit construction. A drive shaft 16 for rotatively driving a rotor 15, which serves as a rotary member of the pump element 13, from the outside of the bodies 11 and 12, is supported by bearings 16*a*, 16*b* and 16*c* under a state that it passes through the front body 11. In addition, the bearing 16*b* is disposed on a portion of the rear body 12 whereas the bearing 16*c* is disposed on a portion of a pressure plate 20(described later in detail).

Reference numeral 17 designates a cam ring which includes an inner cam surface 17*a* fitted on an outer periphery of the rotor 15 having vanes 15*a*, and defines a pump chamber 18 between the inner cam surface 17*a* and the rotor 15. The cam ring 17 is displaceably or movably disposed within an adapter ring 19 so as to make the volume of the pump chamber 18 variable, the adapter ring 19 being fittingly provided on a portion of an inner wall within the accommodating space 14. The adapter ring 19 functions to hold the cam ring 17 so that the cam ring 17 is movable or displaceable within the accommodating space 14 of the body 11. The adapter ring 19 may be formed as an integral portion of the body 11.

Reference numeral 20 designates a pressure plate which is depressingly stuck on and contacted with a side of a pump cartridge constituted by the cam ring 17 and adapter ring 19, the side being located at the front body 11. The opposite side of the pump cartridge is depressingly contacted with an end surface of the rear body 12, the end surface serving as a side plate. Integrally coupling the bodies 11 and 12 together provides a desired assembled status. These components constitute the pump element 13.

The pressure plate 20 and rear body 12 which is stacked on the pressure plate 20 through the cam ring 17 for serving as the side plate, is assembled and fixed to each other under a state that they are circumferentially aligned to each other by a sealing pin 21 which functions as a positioning pin (described later) and by a suitable rotation preventive means.

Reference numeral 23 designates a pump discharge side pressure chamber which is formed in a bottom side of the accommodating chamber 14 of the front body 11 and adapted to effectuate the pump discharge side pressure to the pressure plate 20. Reference numeral 24 designates a pump discharge side conduit which perforates through the pressure plate 20 so that the pressurized fluid flows from the pump chamber 18 into the pump discharge side pressure chamber 23.

Reference numeral 25 designates a pump intake side conduit which is formed in the rear body 12 so that the pump intake side fluid flows into the pump chamber 18 from an intake port 26 provided on a portion of the rear body 12. This conduit 25 is connected to the pump chamber 18 through a pump intake side opening 25a which opens on the end surface of the rear body 12.

Figure 3:
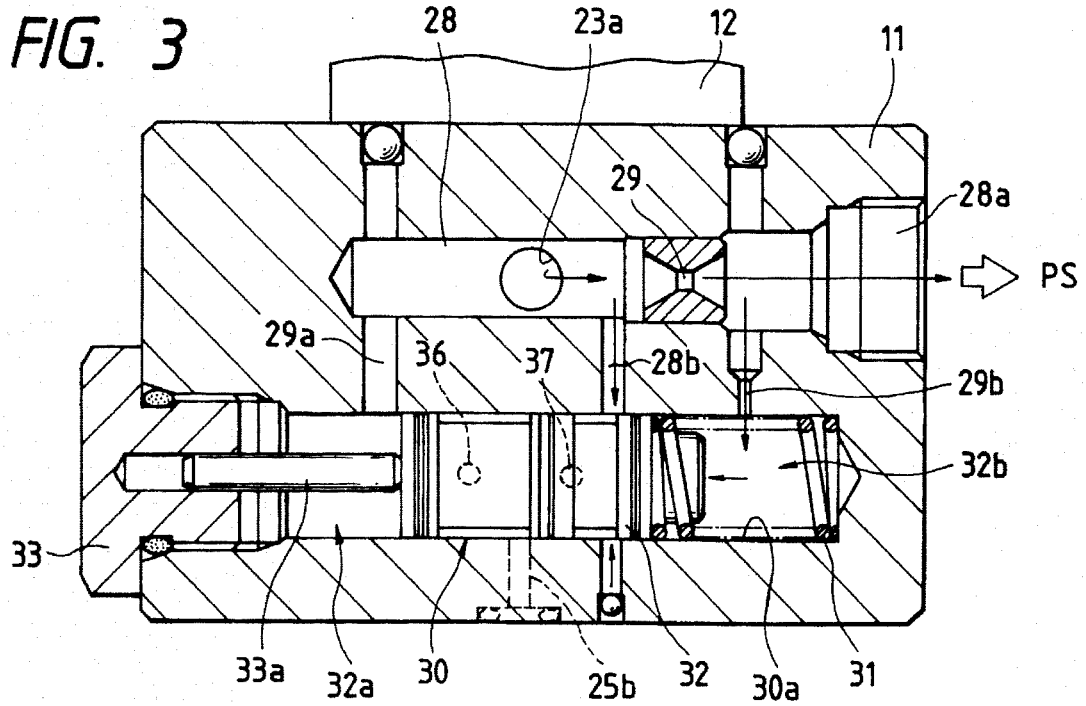
FIG. 3 is a sectional view showing major pars of a switch valve portion of FIG. 1.

Reference numeral 28 designates a pump discharge side conduit which is connected to the pump chamber 18 through the pump discharge side conduit 24, the pump discharge side pressure chamber 23 and a conduit hole 23*a*. The conduit hole 23*a* extends from the pressure chamber 23 upwardly of the front body 11 as shown in FIG. 2. As shown in FIG. 3, the conduit 28 has at its intermediate portion a metering orifice 29 and at its outer end side an outlet port for transmitting the pump outlet side fluid to a hydraulic pressure equipment such as a power steering unit PS.

Reference numeral 30 designates a switch valve used for moving and displacing the cam ring 17 relative to the rotor 15 within the pump body 11 (or the adapter ring 19), which is disposed above the accommodating chamber 14 of the front body 11 and displaced from the pump discharge side conduit 28 orthogonally to the accommodating chamber 14. The switch valve 30 includes a spool 32 having a relief valve, the spool being slidingly driven within a valve hole 30*a* perforated through the body 11 by the virtue of a biasing force of a spring 31 and a pressure difference between front and rear portions of the metering orifice 29 provided in the pump discharge side conduit 28.

Figure 5:
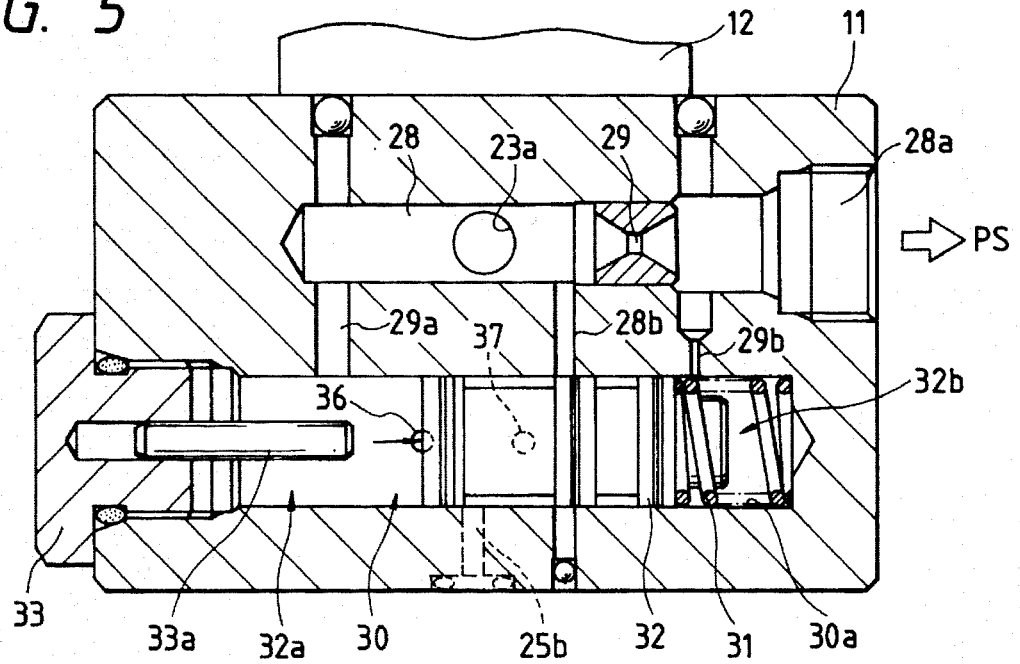
FIG. 5 is a sectional view showing the major parts in the state of FIG. 4.

Reference numerals 29*a* and 29*b* in FIGS. 3 and 5 designate conduits for transmitting pressures on the front and rear portions of the orifice 29 to the valve hole 30*a*, respectively. A high-pressure side conduit 28*b* for transmitting the fluid pressure from the pump discharge side conduit 28 and a low-pressure side conduit 25*b* branching from a portion of the pump intake side conduit 25 so as to transmit the fluid pressure to a tank side are opened on the valve hole 30*a* at a substantially central portion thereof, and are selectively opened and closed in conjunction with the motion of the spool 32 so that the hydraulic pressure is controllably transmitted to first and second hydraulic pressure chambers (described later).

In the switch valve 30 thus constructed above, the hydraulic pressure of the upstream side of the metering orifice 29 is transmitted to the one chamber of the spool 32 (left-hand side chamber in FIGS. 1 and 3) through the pressure chamber 23 of the pump discharge side, the pump discharge side conduit 28 and the conduit 29*a*. In addition, reference numeral 33 in the drawings designates a closing plug for the valve hole 30*a*, which has a rod 33*a* for retaining the spool 32 so as not to close the opening end of the conduit 29*a* when the spool 32 is moved leftward within the valve hole 30*a*.

A spring 31 is disposed in the other chamber 32*b* of the spool 32 (a right-hand side chamber in FIGS. 1 and 3), and the hydraulic pressure of the downstream side of the metering orifice 29 is transmitted from the midway of the conduit 28, located between the orifice 29 and the discharge portion, to the chamber 32*b* through the conduit 29*b*.

Further, pressure transmitting conduits 36 and 37 (including conduit hole 36*a* and 37*b* of the adapter ring 19), are formed through the body 11 and the adapter ring 19, and opened on a substantially central portion of the valve hole 30*a* in such a manner that the open ends of the conduits 36 and 37 are aligned in the moving direction of the spool 32. The conduits 36 and 37 are respectively communicated with the first and second hydraulic pressure chambers 34 and 35 which are defined between the cam ring 17 and the adapter ring 19 around the outer periphery of the cam ring 17. Reference numeral 34*a* in FIGS. 1 and 4 designates a recess-like groove for securing the hydraulic pressure chamber 34 between the cam ring 17 and the inner wall of the adapter ring 19 even when the cam ring 17 is moved to make the pump chamber 18 maximum.

As clearly shown in FIGS. 1 and 3 or 2 and 4, due to the motion of the spool 32, the conduits 36 and 37 are selectively communicated with the pump discharge side conduit 28 though the conduit 29*a* or 28*b* or with the pump intake side opening 25*a* through the conduit 25*b*.

Figure 4:
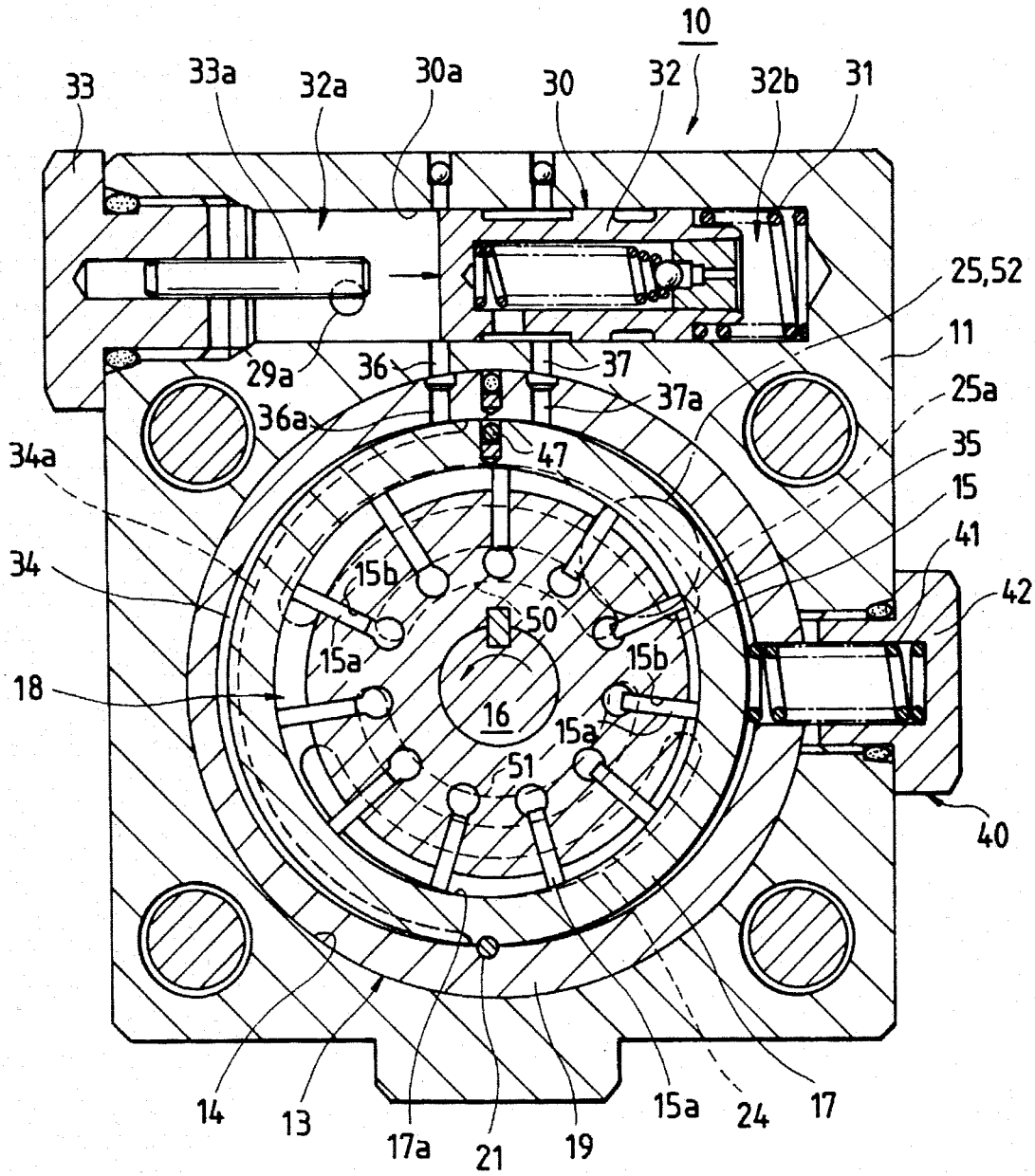
FIG. 4 is a sectional, schematic view for explaining a state that the pump is driven from a state shown in FIG. 1.

Reference numeral 40 in FIGS. 1 and 4 designates a depressing member for biasing the cam ring 17 which is displaceably disposed within the pump bodies 11 and 12, so that the volume of the pump chamber 18 between the cam ring 17 and the rotor 15 is made maximum. The depressing member 40 is made up of a coil spring 41 and a hollow retainment plug 42.

Since other construction of the vane type variable displacement pump 10 mentioned above is known in the art, the detailed description therefor is omitted here.

The variable displacement pump according to the present invention is characterized in that the cam ring 17 is eccentrically fitted on the rotor 15 so as to form the pump chamber 18 therebetween, and is movably or displaceably disposed within the pump bodies 11 and 12. Further, the cam ring 17 is biased so that the pump chamber 18 is made maximum. Furthermore, the sealing pins 11 and 12 serving as sealing means are provided on appropriate portions in an annular space formed around the outer periphery of the cam ring 17 between the pump bodies 11 and 12 so as to define the first and second hydraulic pressure chambers 34 and 35 for moving and displacing the cam ring 17 within the pump bodies 11 and 12. Moreover, there is provided the switch valve 30 which is driven depending on the discharge amount of the pressurized fluid or oil from the pump chamber 18 so as to control the pressures of the fluid or oil supplied to the first and second hydraulic pressure chambers 34 and 35.

In order to divide the annular space formed between the cam ring 17 and the adapter ring 19, in the embodiment of the present invention the annular space is divided into left-hand side and right-hand side spaces in such a manner that the first sealing pin 21 and the second sealing pin 47 are provided vertically in FIG. 1. The first sealing pin 21 serves also as a positioning pin and a pivot axis. The second sealing pin 47 with an elastic member is incorporated in a recess formed in a sliding contact portion of the cam ring 17.

The left-hand side space is used as the first hydraulic pressure chamber 34 and designed to be connectable through the fluid conduits 36*a* and 36 to the left-hand side chamber 32*a* of the switch valve 30 or to the pump intake side. On the other hand, the right-hand side space is used as the second hydraulic pressure chamber 35 and designed to be selectively connectable through the fluid conduits 37*a* and 37 to the pump discharge side or the pump intake side in conjunction with the motion of the spool 32.

The hollow depressing member 40, as best shown in FIGS. 1 and 4, is designed to always urge the cam ring 17 in the left-hand side direction of FIG. 1 through the coil spring 41. The depressing member 40 may be formed as other construction as long as it depresses and urges the cam ring 17 so that the volume of the pump chamber 18 is made maximum.

According to the arrangement noted above, when the pump 10 is at starting, the cam ring 17 is brought in a state that the cam ring 17 is biased by the coil spring 41 of the depressing member toward one side of the accommodating space 14 of the body 11 so that the volume of the pump chamber 18 between the rotor 15 and the ring 17 is made maximum, as shown in FIG. 1. In this state, the switch valve 30 is brought in a state that the first hydraulic pressure chamber 34 is communicated with the pump intake side whereas the second hydraulic pressure chamber 35 is communicated through the conduit **28*b*** with the pump discharge side.

Thereafter, when the pump is driven with its revolution number being increased gradually, the spool 32 of the switch valve 30 is activated by the virtue of the hydraulic pressure difference between the upstream and downstream sides of the orifice 29, which pressure difference is obtained in proportion to the pump revolution number, to thereby selectively connect the pump discharge side and pump inlet side to the first and second hydraulic pressure chambers 34 and 35 located at respective sides of the cam ring 17. As a consequence, the cam ring 17 eccentrically arranged relative to the rotor 15 is moved against the biasing force of the coil spring 41 in a direction to decrease the volume of the pump chamber 18 as shown in FIGS. 1 and 4.

At this time, the switch operation of the switch valve 30 by the spool 32 in accordance with the flow amount of the pump discharge side causes the pump discharge side and the pump intake side to be connected to the first hydraulic pressure chamber 34 and the opposite second hydraulic pressure chamber 35 suitably, so that the cam ring 17 is correspondingly moved in accordance with the operation status of the switch valve 30. Consequently, the amount of the flow discharged from the pump 18 whose internal volume is changed is controlled in a required condition, so that the supply of the flow at a predetermined flow quantity characteristic to the power steering unit PS can be achieved.

Figure 6A:
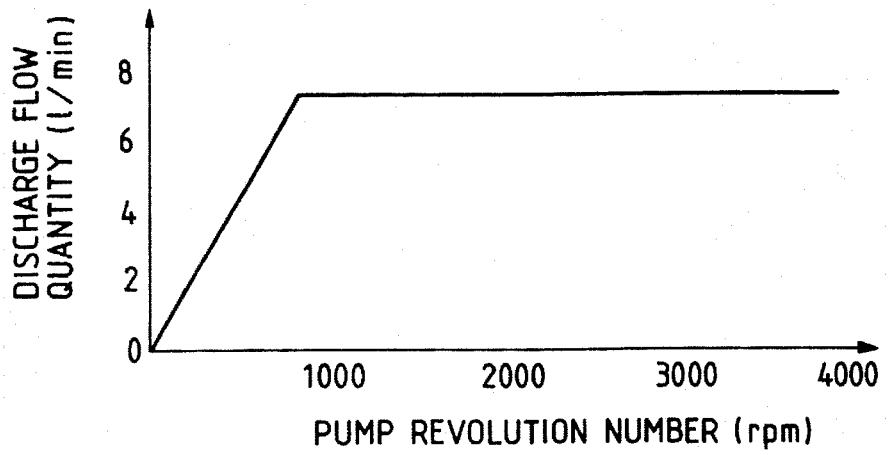
FIGS. 6A, 6B and 6C show a characteristic of quantity of the discharge flow relative to the pump revolution number, a characteristic of the cam ring deviation relative to the pump revolution number, and a relationship between the eccentric amount and the own discharge flow quantity, respectively.
Figure 6B:
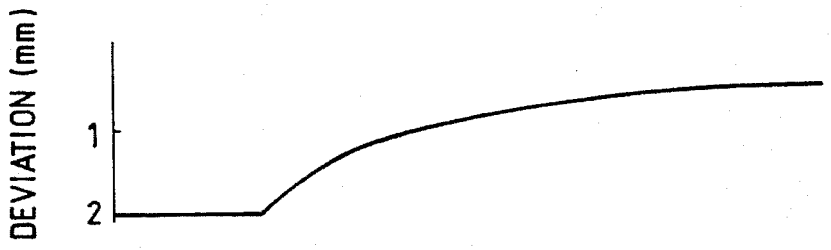
Figure 6C:
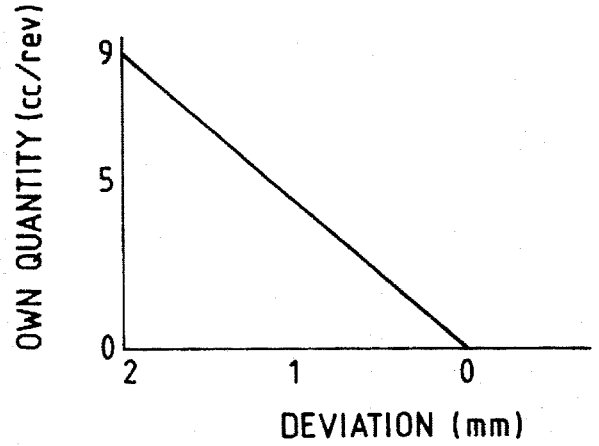

In particular, according to the above-noted arrangement, the switch valve 30 is switched or shifted by the pressure difference produced in front of and behind the metering orifice 29 by the pump discharge flow increased or decreased in amount in association with the pump revolution number, to thereby enable the displacement of the cam ring 17 against or in accordance with the biasing force of the coiled spring 41. Thus, the internal volume of the pump chamber 18 can be variably controlled such that the amount of the flow from the pump can be balanced in conformity with the pump revolution number to provide a desired characteristic as shown in FIG. 6A. In addition, the characteristic curve shown in FIG. 6A shows a characteristic of the pump discharge flow amount relative to the pump revolution number. FIG. 6B shows relationship of a displacement of the cam ring 17 relative to the pump revolution number. FIG. 6C shows a relationship of a pump peculiar flow amount (a flow amount per one revolution of rotor) relative to the displacement of the cam ring 17.

Further, according to the arrangement of the present invention as mentioned above, the hydraulic pressures having a predetermined pressure difference can be transmitted, by the switch valve 30 driven depending on the flow amount of the pump discharge side, to the respective first and second hydraulic pressure chambers 34 and 35 which are respectively formed around the outer periphery of the cam ring 17 eccentrically fitted on the rotor 15 within the pump bodies 11 and 12. Thus, the cam ring 17 can be moved and displaced in a desired direction. Consequently, the internal volume of the pump chamber 18 formed between the rotor 15 and the cam ring 17 can be varied surely, whereby the amount of the flow at the pump discharge side can be variably controlled as desired.

In particular, according to the present invention, the swingingly displacement or movement of the cam ring 17 about the sealing pin 21 for flow control noted above is produced by transmitting hydraulic pressures to the hydraulic pressure chambers 34 and 35 formed at right and left hand side portions of the cam ring 17, using the switch valve 30 switchingly driven for the cam ring drive control by virtue of the pressure difference between the upstream and downstream of the orifice 29.

Therefore, according to the present invention, the switch valve 30 can provide the sufficient hydraulic pressure difference for moving the cam ring 30 in comparison with the conventional arrangement wherein the cam ring 17 is directly moved by the pressure difference between the front and rear portions of the orifice 29. Thus, it is possible to obtain a desired amount of displacement of the cam ring 17 so that the amount of flow discharged from the pump is controlled in a required condition.

For example, even when the bodies 11 and 12 are deformed due to the fact the pump discharge pressure becomes excessively high or the dust or the like enters in the fluid and clogged to hinder the movement of the cam ring 17, the cam ring 17 can be smoothly moved with a strong force since the force for moving the cam ring 17 is produced by a difference between the pump discharge pressure and the pump intake pressure sufficiently smaller than the pump discharge pressure. Thus, a predetermined amount of flow can be stably obtained. Further, the present arrangement has an advantage that consumptive power is reduced since the pressure difference between the upstream and downstream of the orifice can be made small.

Further, according to the present arrangement, it is possible to provide a variable displacement pump which can reduce the energy loss and the oil temperature increase in comparison with a constant capacity type pump, extremely easily without any increase of the entire pump size. Further, the variable displacement type pump according the present invention is superior in machining and assembling properties and in view of mass production.

Here, in the present embodiment, the cam ring 17 can be displacingly moved under the eccentric status, and the inner wall of the cam ring 17 can be formed as a complete circle. Thus, the cam ring 17 is superior in view of machining.

Further, in the present embodiment, the variable displacement pump 10 is constituted such that the number of the vanes **15*a* in the rotor 15 is set at an uneven number in order to reduce an irregular force acting on the rotor 15 due to the hydraulic pressure difference within the pump chamber 18** as greatly as possible, and to thereby reduce the pulsating flow at the pump discharge side as greatly as possible.

That is to say, in a pump arrangement wherein the cam ring 17 is eccentrically disposed relative to the rotor 15 so as to form the pump chamber 18 at a biased location on one side of the rotor 15, providing the uneven number of vanes **15*a* makes it possible to dispose one vane 15*a* and two vanes 15*a*, respectively, in right and left boundaries each defined between pump intake and discharge side chambers and located axially symmetrically relative to the other with respect to rotor 15. This vane arrangement can counterbalance the force on the vane located in the left hand side boundary with the force on the vanes located in the right hand side boundary so that the rotor 15** receives the substantially balanced force, not the irregular force.

On the contrary, if the vanes 15*a* are of an even number, two vanes 15*a* are distributed in each of the boundaries so that one receives the force from the pump discharge side and the other receives the force from the pump intake side. Thus, the unbalanced force is made large, and as a result, the irregular force is generated on the rotor 15. As is clear from the above-description, the uneven number arrangement of the vanes is superior to the even number arrangement thereof.

Further, in the present embodiment, a sliding resistance between the inner wall of the cam ring 17 and the vane 15*a* which is retractably and extendibly held in the rotor 15 is reduced as greatly as possible, so that a drive torque required for rotating the rotor 15 is reduced as greatly as possible. That is to say, as shown in FIGS. 1 and 2, an arcuate groove 50 for the pump intake side of the pump chamber 18 is formed on each of side wall portions of the pressure plate 20 and the rear body 12, correspondingly to proximal portion of the vane accommodating slit grooves 15*b* of the rotor 15. Similarly, an arcuate groove 51 for the pump discharge side of the pump chamber 18 is formed on each of side wall portions of the pressure plate 20 and the rear body 12, correspondingly to proximal portion of the vane accommodating slit grooves 15*b* of the rotor 15. The hydraulic pressures of the pump intake and discharge sides are transmitted to these arcuate grooves 50 and 51, respectively. In addition, reference numeral 52 designates a path or conduit through which pump intake side fluid is transmitted from the conduit 25 to the arcuate groove 50, whereas reference numeral 53 designates a path or conduit through which the arcuate groove 51 is communicated with the pump discharge side pressure chamber 23.

According to this arrangement for the vanes 15*a* which is extendably or contractibly held on the rotor 15 rotating within the cam ring 17, when the distal portions of the vanes 15*a* are slid on the inner circumference of the cam ring 17 and are located in one of a pump discharge side area (a lower side in FIG. 1) and a pump intake side area (an upper side in FIG. 1) of the pump chamber 18, the proximal portions of the vanes 15*a* receive substantially the same pressure as that of the one of the pump discharge side area and the pump intake side area where the distal portions of the vanes 15*b* are located. Thus, it is possible to reduce the friction resistance between the each distal portion of the vanes 15*a* and the inner circumference of the cam ring 17, to thereby prevent the wear and to reduce the loss in the drive power.

Figure 7A:
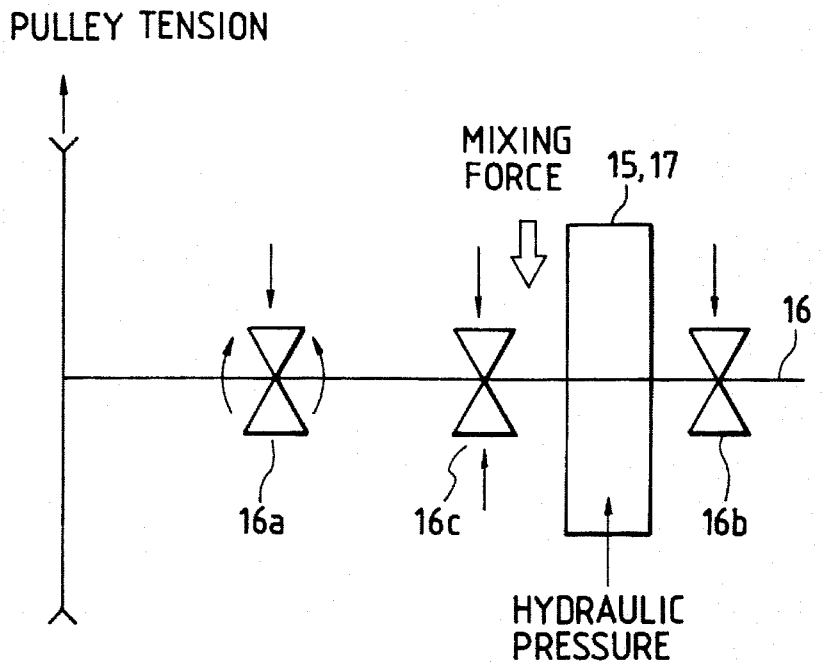
FIG. 7A and 7B are a schematic diagram and a schematic, sectional view, each for explaining a case that an unbalanced hydraulic pressure is solved by a pulley-tensile direction.
Figure 7B:
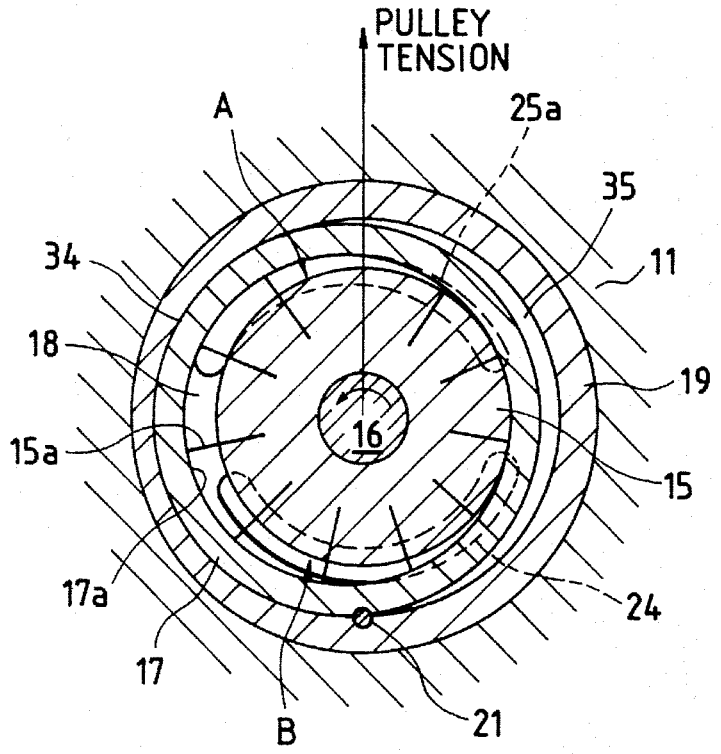

In the variable displacement type pump 10 of the above-noted construction, since the inner volume of the chamber 18 is varied by the swinging or pivot motion of the cam ring 17, only one pair of intake port and discharge port adversely produces the pressure unbalance which causes the excessive load on the rotor axis 16. That is to say, since the cam ring 17 is positioned eccentrically relative to the rotor 15 and the pressurized oil is introduced into and discharged from one pump chamber 18, the pressure difference between the pump intake side area (designated by A in FIG. 7B) and the pump discharge side area (designated by B in FIG. 7B) within the pump cartridge portion causes a biasing force onto the rotor axis 16 when the hydraulic pressure acts on the pump 10. This biasing force causes reactive biasing forces onto the bearings 16c and 16*b* which support the rotor axis 16, and the resultant mixing force of the reactives acts on the bearings at only a side with respect to the rotor axis 16 (see FIG. 7A), whereby the durability of the bearings are deteriorated.

In order to prevent the above-noted problem occurring due to the biased force caused by the pressure difference between the pump intake and discharge sides, that is, to prevent increase of the load on the bearings, the present embodiment takes an improved arrangement wherein a tensile direction of a pulley which connects an outer end of the rotary axis 16 to an external drive source is set at a direction toward the pump intake side from the pump discharge side (the direction being marked with an arrow in FIG. 7A), taking into consideration the biasing force due to the pressure difference between the pump discharge and intake sides. This arrangement can reduce the load applied onto the bearings or the like as greatly as possible, to thereby provide an advantages in view of the durability thereof.

Figure 8:
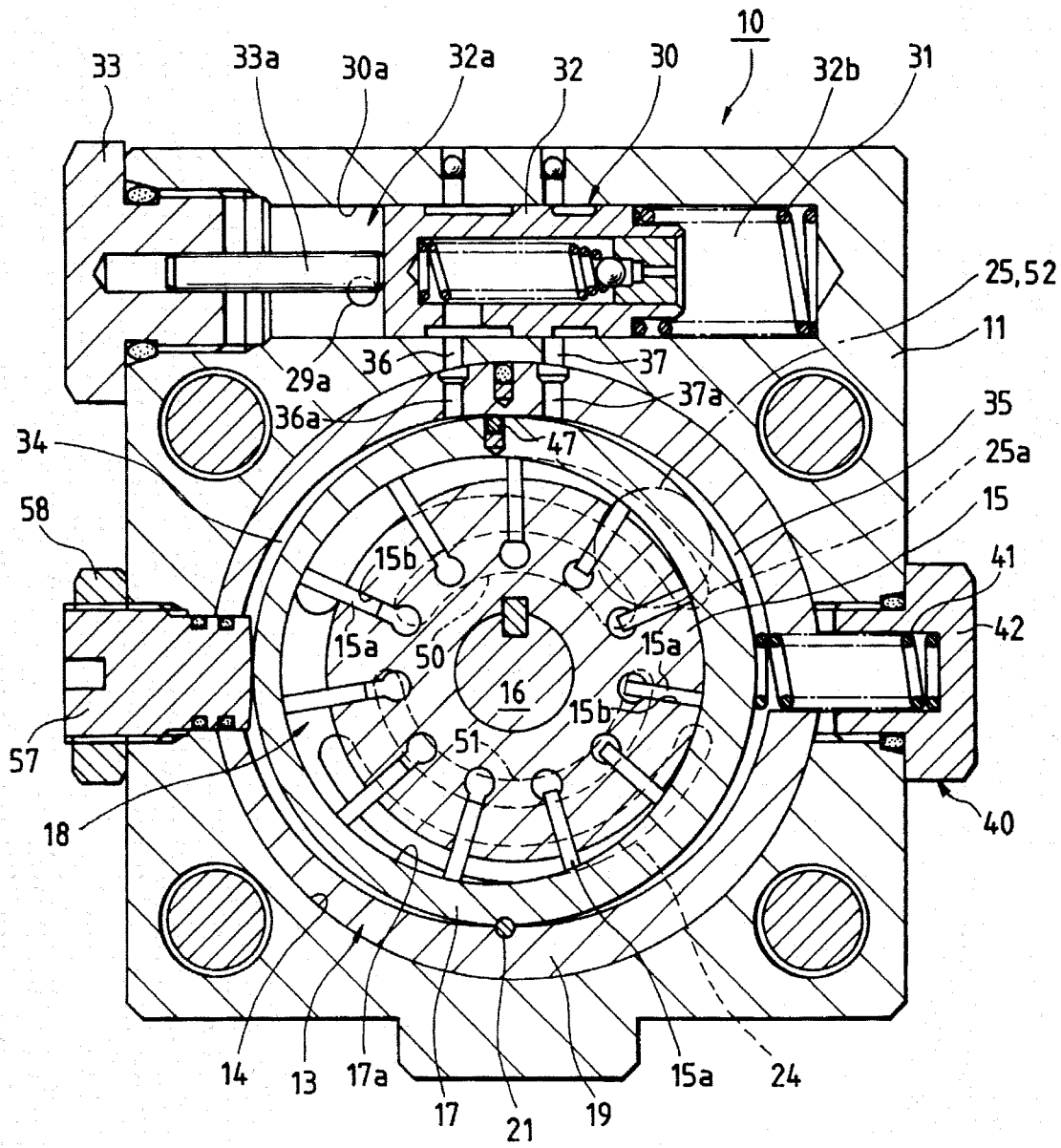
FIG. 8 is a transversely sectional schematic view showing a second embodiment of the present invention.

FIG. 8 shows another embodiment of a variable displacement type pump according to the present invention. As can be seen from the drawing, adjustment screw or threading means 57 for adjusting the maximum eccentric displacement of the cam ring 17 relative to the rotor 15 is threadingly engaged onto and with the pump body (e.g., the front body 11) at location opposite to the depressing member 40, so as to move the cam ring 17 against the biasing force of the coiled spring 17 through its frontward and rearward motion and to thereby adjust the amount of the eccentric displacement. In addition, reference numeral 58 designates a lock nut. Other construction is the same as that of the first embodiment described above with reference to FIGS. 1 to 7o According the second embodiment, since it is possible to mechanically adjust the amount of the eccentric displacement of the cam ring 17 relative to the rotor 15, the desired assembled condition and the accuracy thereof can be obtained with the threading adjustment of the screw 57 even when the pump cartridge portion made up of the pump bodies 11 and 12 (including 19 if desired), the cam ring 17 and the rotor 15, and further the depressing member 40 including the coiled spring 41 and so on are machined and/or assembled in rough accuracy. Further, various and desired Q-N characteristics (characteristics of the discharge flow quantity or amount relative to the revolution number) can be obtained from a common pump 10.

That is to say, the adjustment through the eccentric displacement adjusting screw 57 enables the desired break point setting for the Q-N characteristic without the high accuracy machining of the components, e.g. the adapter ring 17 and the cam ring 19 which form eccentric arrangement. Thus, it is possible to enhance the mass production properties of the components and to reduce the production cost therefor.

Figure 9:
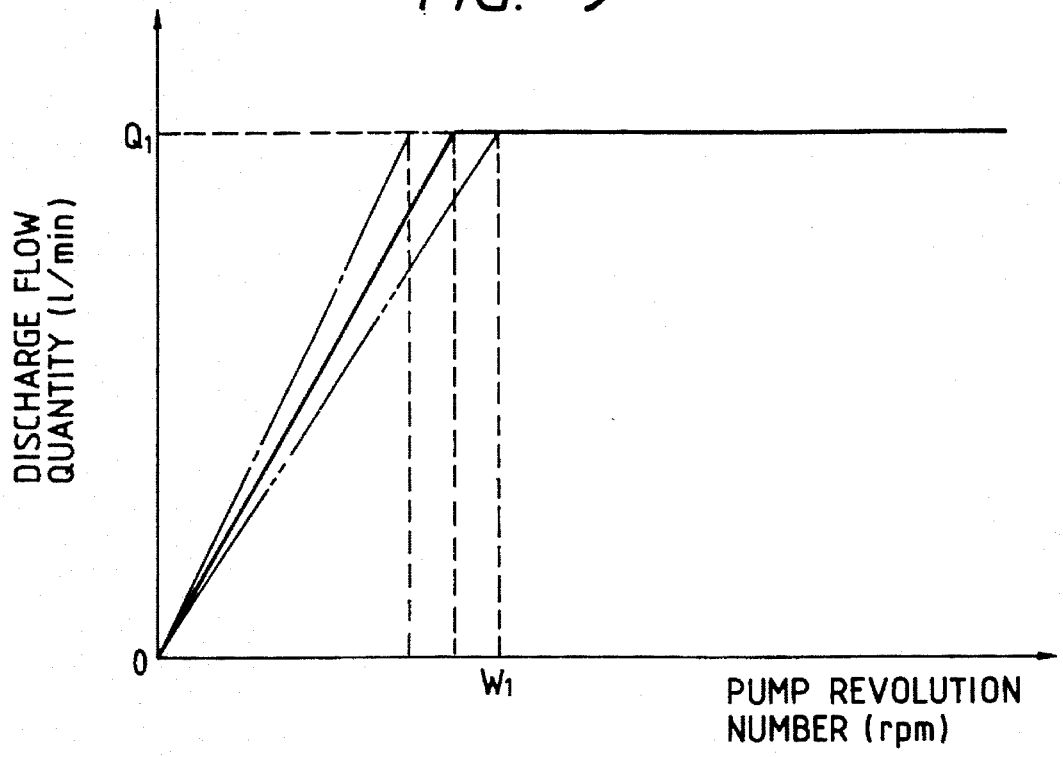
FIG. 9 shows exemplified characteristics produced by the second embodiment.

For example, the pump of the invention can present the characteristics shown by solid line, one-dotted chain line and two-dotted chain line of FIG. 9 through the fine adjustment or control of the adjusting screw 57. As can be seen, the characteristic of the discharge flow quantity Q relative to the pump revolution number N can be set as desired. For example, according to this arrangement it is possible to adjustably vary the revolution number $W_1$ on the break point at which the flow quantity $Q_1$ is obtained. This provides the great advantage in practical utilization.

Figure 10:
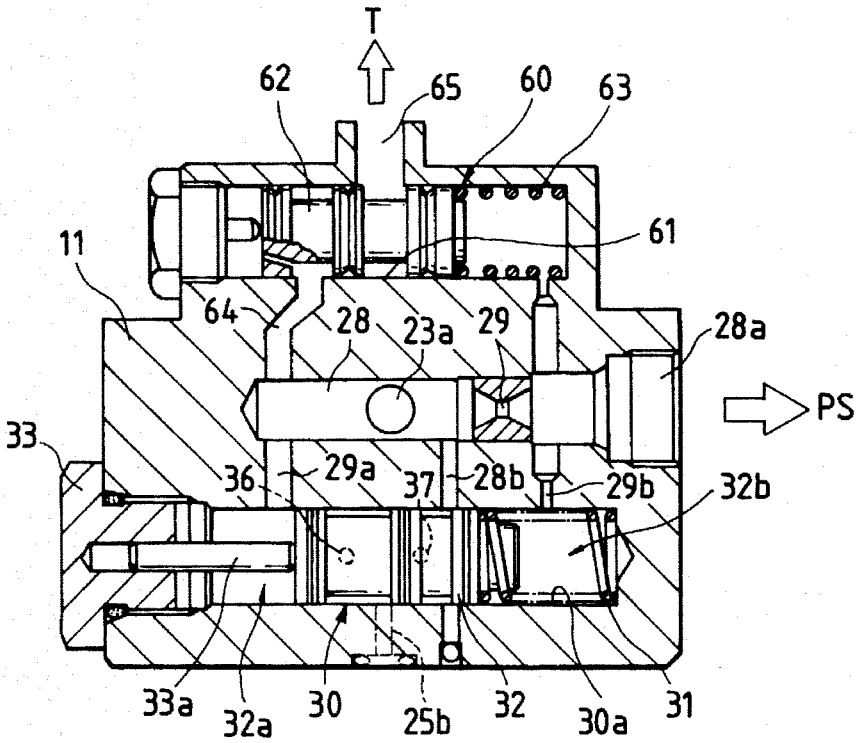
FIG. 10 is a schematic, sectional view showing major parts of a third embodiment of the present invention.
Figure 11A:
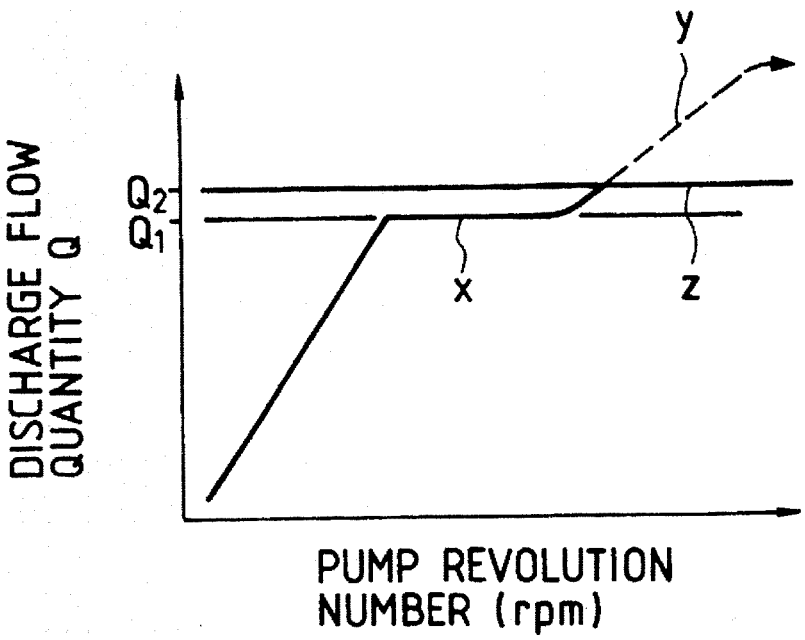
FIG. 11A and 11B show a characteristic produced by the third embodiment and a comparative characteristic, respectively.

FIGS. 10 and 11 show yet another embodiment of a variable displacement type pump according to the present invention. In this third embodiment, a flow control or relief valve 60 for fail-safety is provided on the midway of the pump discharge side conduit 28 communicated with the pump chamber 18. The valve 60 is set so as to be activated by a flow quantity which is slightly higher than the adjusted maximum flow quantity discharged from the pump chamber 18. Reference numeral 61 designates a valve hole, 62 a spool which is slidingly held inside the valve hole 61, and 63 a spring for biasing the spool 62. A conduit 64 branching from the pump discharge side conduit 28 communicates the conduit 28 with a chamber located at one side of the spool 62. An opening is provided at a central portion to define a circulating passage or conduit 65 which is communicated with a tank T. When the quantity of flow on the conduit 28 exceeds a predetermined one, the valve 60 is activated to release a part of the flow to the tank side (i.e. pump intake side).

By the use of the flow control valve 60 for the fail-safety wherein it is set at the flow quantity $Q_2$ slightly greater than the maximum quantity $Q_1$ of flow discharged from the pump 18, it is possible to maintain the flow quantity Q of the pump discharge side so as not to become greater than the set flow quantity $Q_2$ through the action of the control valve 60, even when the movable cam ring 17 is fixingly caught on the body 11 by clogging of the dust or the like contained in the pressurized fluid. Thus, it is possible to secure the reliability of the pump even under a situation where the undesired increase of the pump discharge quantity accidentally occurs.

Figure 11B:
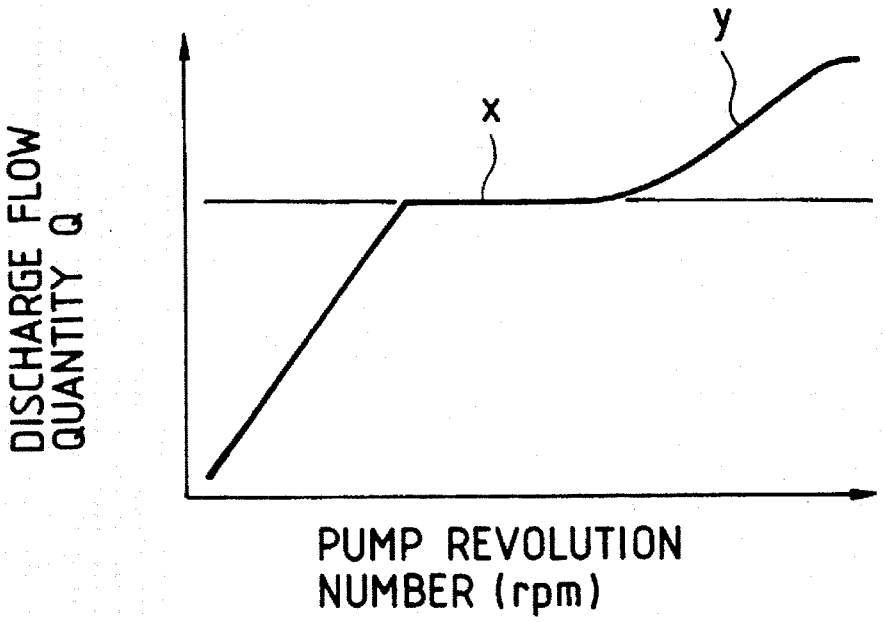

That is to say, if the cam ring is caught so as not to be displaced, there is an accidental possibility wherein the discharge flow quantity is increased as shown by the characteristic from X to Y in FIG. 11B. However, in the present arrangement it is possible to obtain a characteristic shown by the solid line from X to Z in FIG. 11A owing to the provision of the flow control valve 60 even under such accidental condition.

According to this arrangement, the flow control valve 60 is prevented from being activated as long as the cam ring 17 properly functions, so that the pump of the invention never suffers from the energy loss occurring when the pump discharge side flow is circulatingly released to the intake side, and further is properly and surely activated to maintain the pump discharge flow quantity characteristic in a predetermined status if the necessary condition is met. Accordingly, there is no possibility that the large amount of flow is accidentally discharged to suddenly lighten the handle through the power steering unit PS in a high speed running condition.

In addition, the pump arrangement to which the flow control valve 60 is applied for fail-safety, should not be restricted to that described in association with each of the first to third embodiments of the invention. The flow control valve 60 may be applied to the well-known variable displacement type pump in the prior art.

Figure 12:
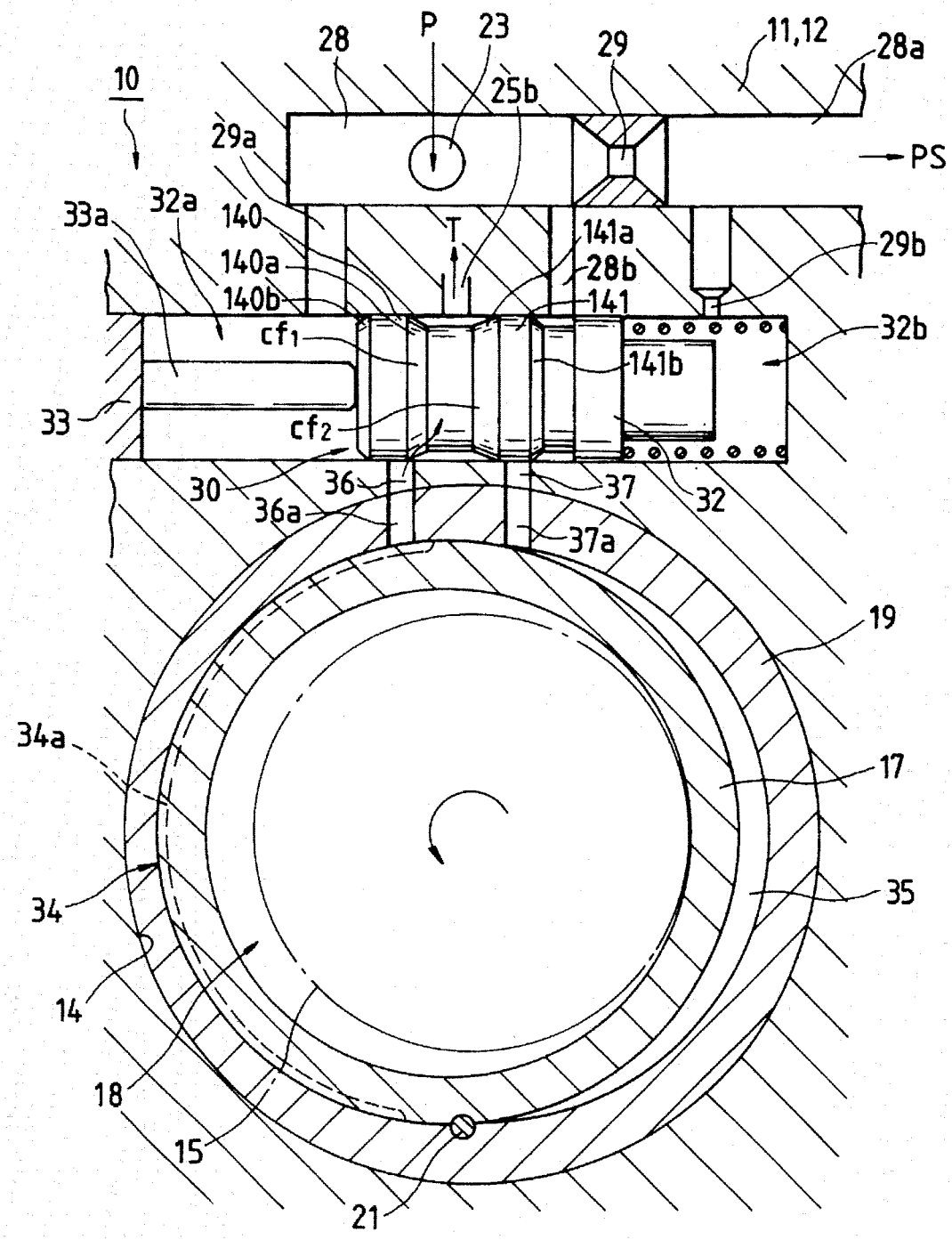
FIG. 12 is a schematic, sectional view showing a fourth embodiment in an initial state illustrating a positional relationship between a cam ring and a switch valve.
Figure 13:
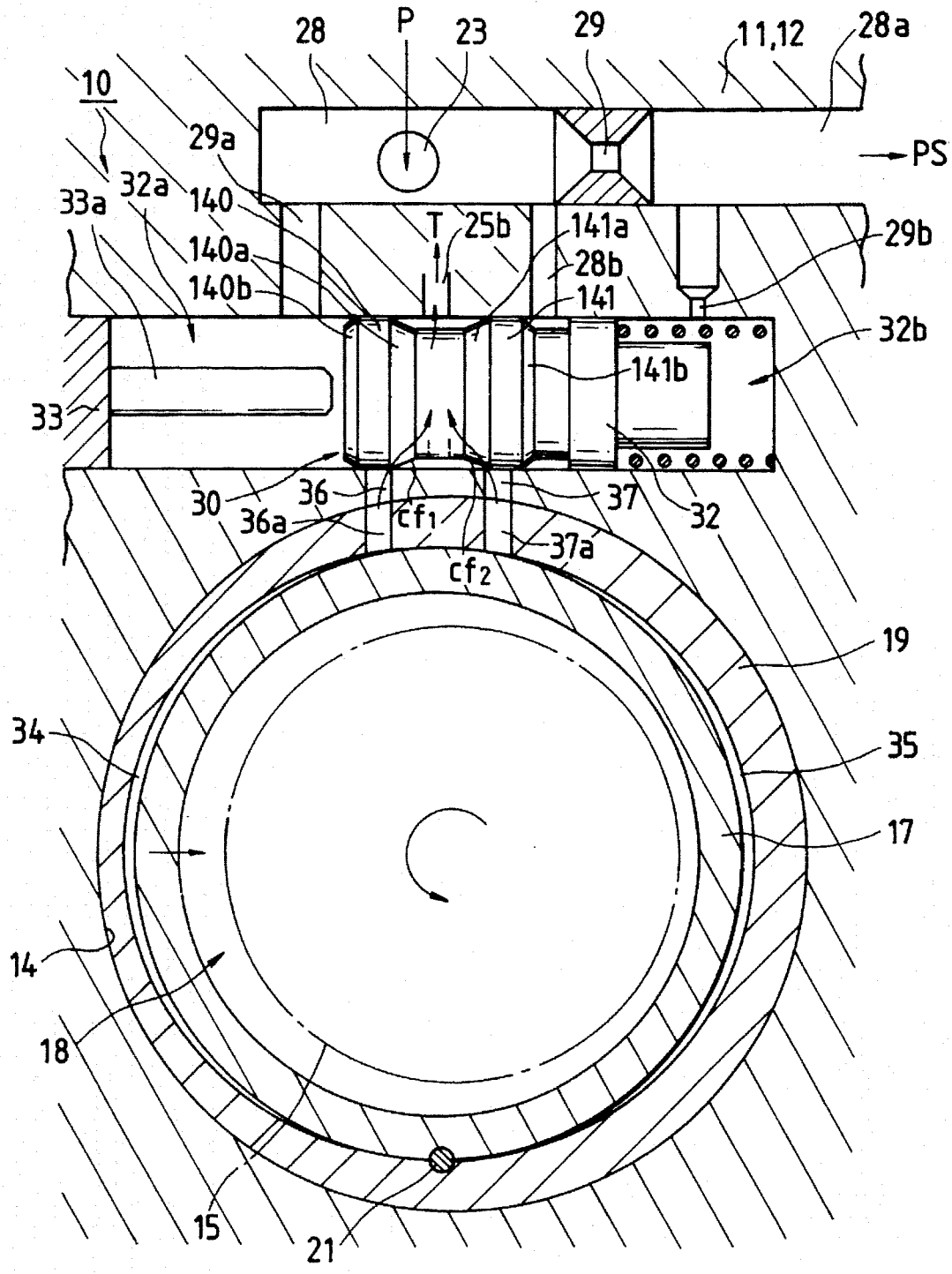
FIG. 13 is a schematic, sectional view showing the fourth embodiment in a state that the same pressure is applied to hydraulic pressure chambers provided at both sides of the cam ring during the switch valve activation.
Figure 14:
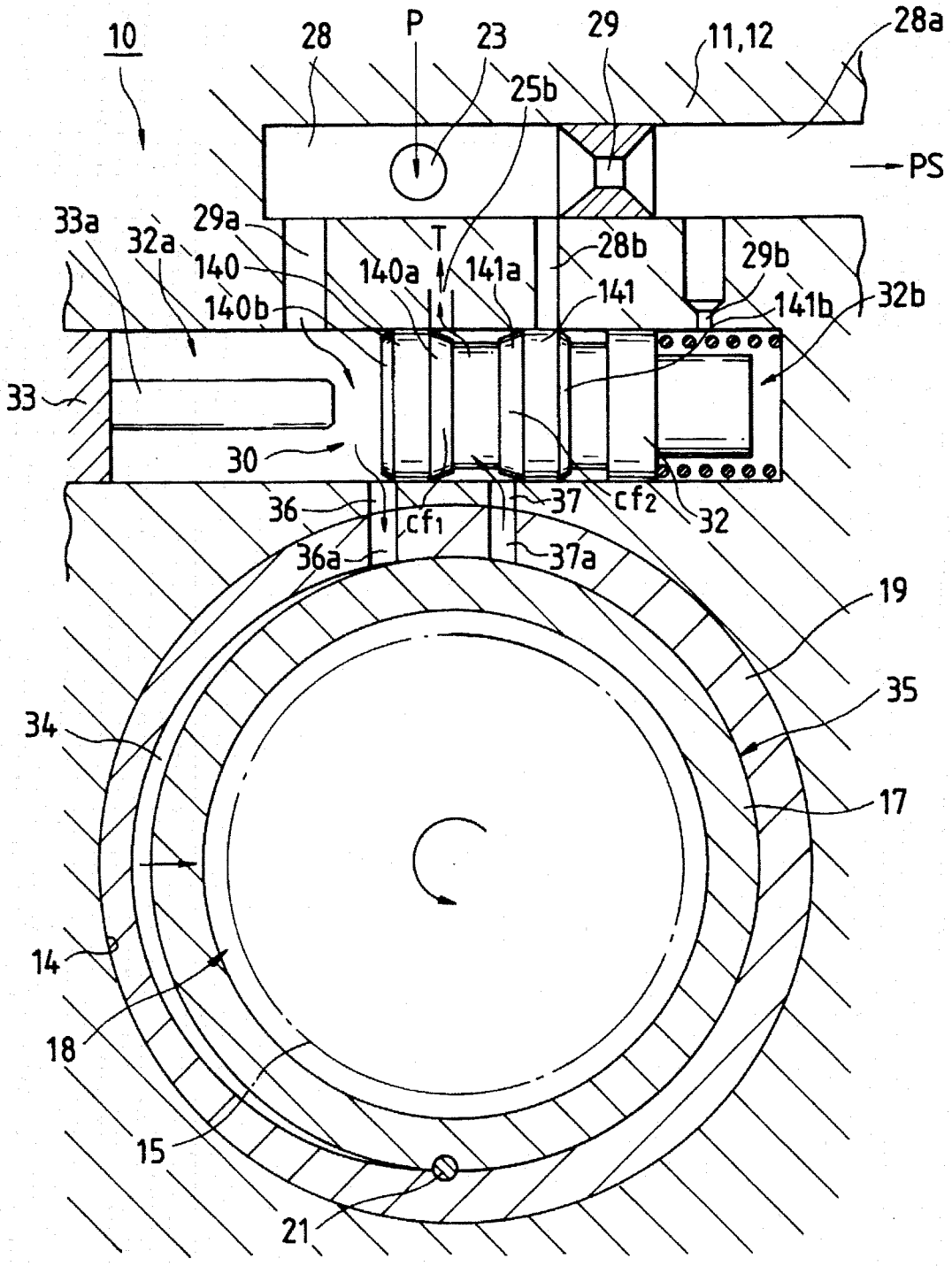
FIG. 14 is a schematic, sectional view showing the fourth embodiment in a state that a pump chamber is made minimum during the switch valve activation.

FIGS. 12 to 14 show a fourth embodiment of a variable displacement type pump according to the present invention. In the fourth embodiment, the spool 32, when being activated, can define an area wherein both the conduits 36 and 37 respectively communicated with the first and second hydraulic pressure chambers 33 and 34 are connected to one of pump discharge side P and the pump intake side T simultaneously.

In the present embodiment, the lands 140 and 141 of the spool 32 is formed with chamfers 140*a* and 141*a* (cf1 and cf2) so that a movable discharge area of the spool 32 has an area wherein both the conduits 36 and 37 communicated with respective first and second hydraulic pressure chambers 34 and 37 are communicated with the pump intake side T, as shown in FIG. 13. That is to say, the present embodiment is arranged such that both the conduits 36 and 37 can be communicated between the lands 140 and 141 through the chamfers 140*a* and 141*a* with the conduit 25*b* communicated with the pump intake side T when the spool 32 is activated.

By forming the chamfers 140*a* and 141*a* on the lands 140 and 141 which function to switch paths on the spool 32 of the switch valve 30, or by modifying the conduit arrangement taking into consideration the opening and closing timings by the spool 32, both the hydraulic pressure chambers 34 and 35 on respective sides of the cam ring 17 can be temporally communicated with one of the pressure higher side (pump discharge side P) and the pressure lower side (pump intake side T, e.g. tank side), during the valve activation. Owing to this, even when the pump discharge side pressure is changed due to the load on the power steering unit P, it is possible to prevent random minute motions of the spool 32 and to control the hydraulic pressure change gently, and to thereby obtain the stable discharge flow quantity characteristic in any revolution numbers and loading areas.

Figure 15:
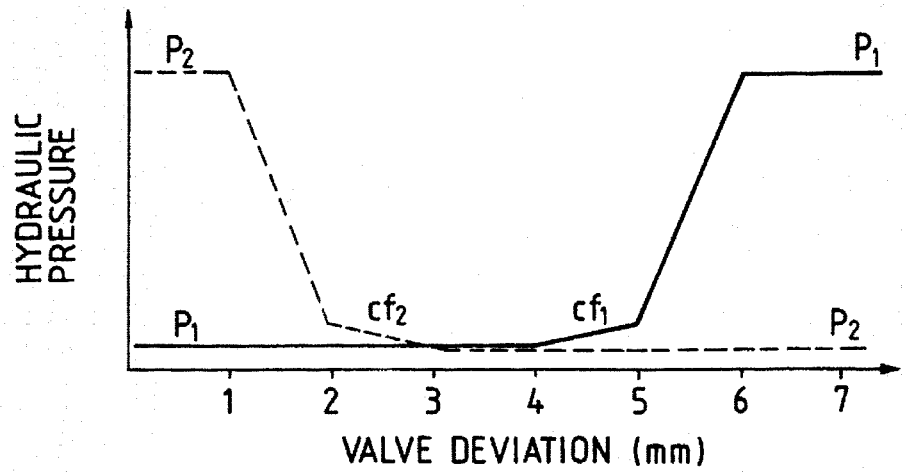
FIG. 15 shows a hydraulic pressure characteristic with respect to the valve deviation.

In the present embodiment, the chamfers 140*a* and 140*b* make it possible to communicatingly connect both the chambers 35 and 36 to the pump intake side T in the midway of the conduit switch operation of the spool 32 to change the characteristic of the hydraulic pressure gently and to prevent valve oscillation or vibration, as a result of which a relationship as shown in FIG. 15 can be obtained between pressures $P_1$ and $P_2$ in chambers 35 and 36. Portions referenced by $cf_1$ and $cf_2$ on the characteristic curves in FIG. 15 are the hydraulic pressure controlled portions by the virtue of the chamfers 140*a* and 141*a*.

Figure 16A:
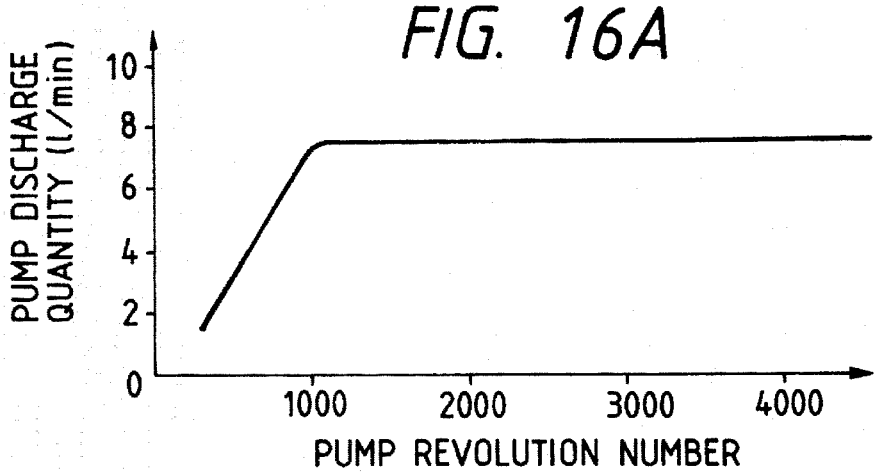
FIG. 16A and 16B show a characteristic of the quantity of the pump discharge flow relative to the pump revolution number in accordance with the fourth embodiment, and a comparative characteristic, respectively.
Figure 16B:
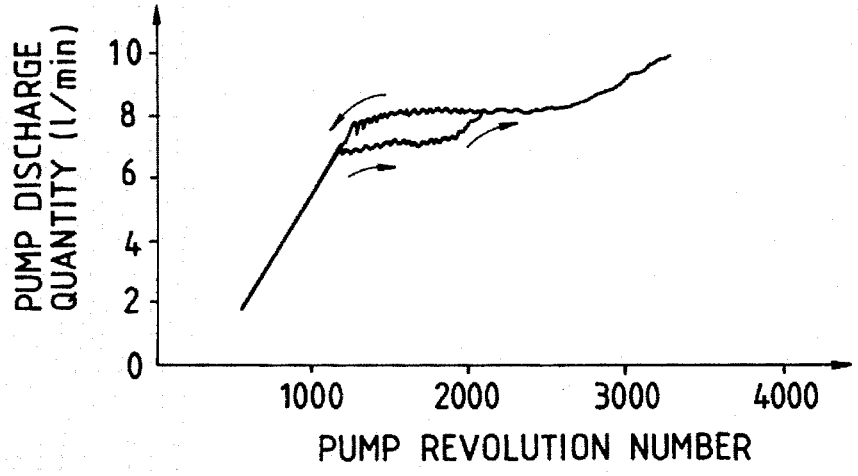

An experimental result showed that the present arrangement presented a stable discharge flow characteristic depending on the pump revolution number as shown in FIG. 16A and removed pulsing phenomenon occurring in the prior arrangement as shown in FIG. 16B.

In addition, the fourth embodiment shown in FIGS. 12 to 14 shows one example wherein chamfers 140*b* and 141*b* are formed on the lands 140 and 141 for smooth flow of the pressurized oil.

Figure 17:
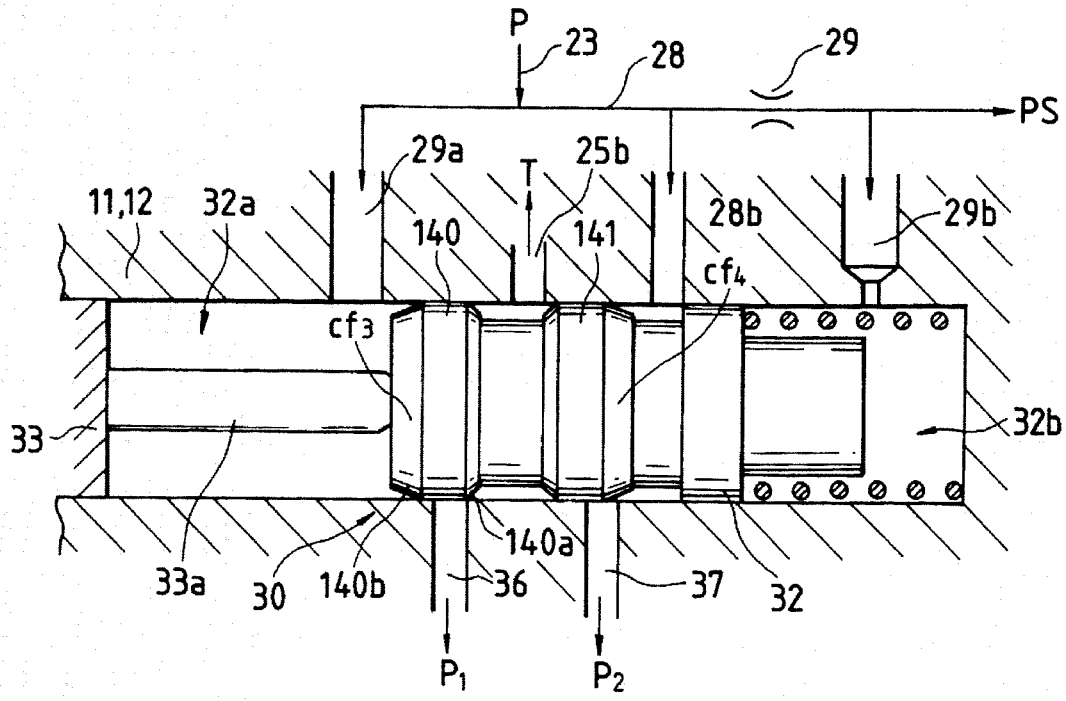
FIG. 17 is a schematic, sectional view showing major parts of a fifth embodiment of the present invention in an initial state.
Figure 18:
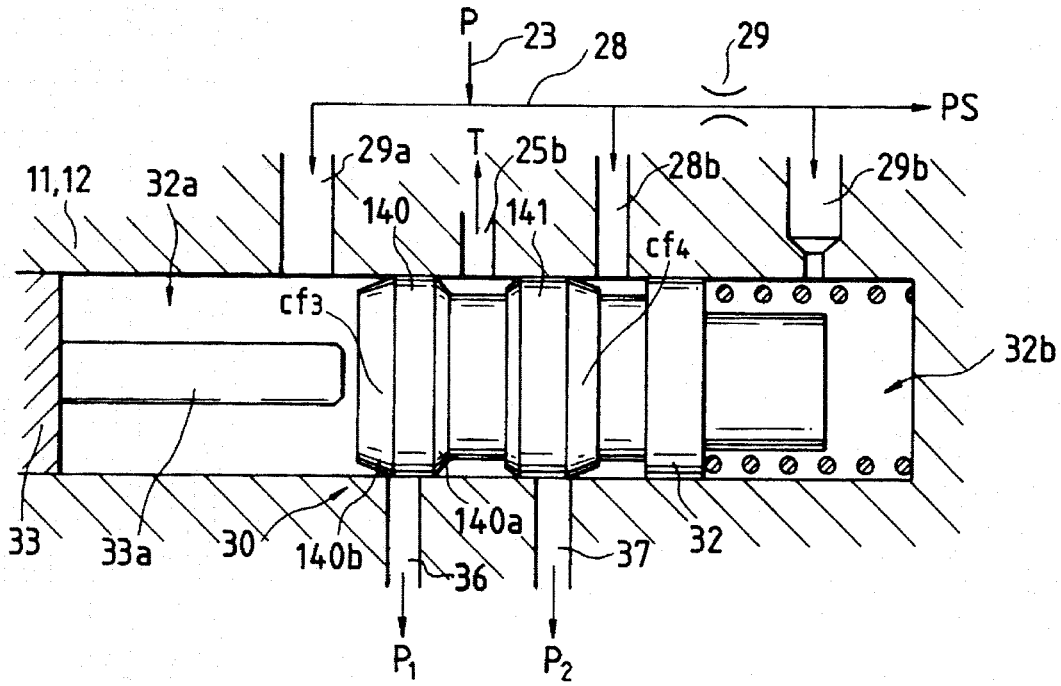
FIG. 18 is a schematic, sectional view showing the major parts of the fifth embodiment in a state that the same pressure is applied to both hydraulic pressure chambers around the cam ring during the valve activation.
Figure 19:
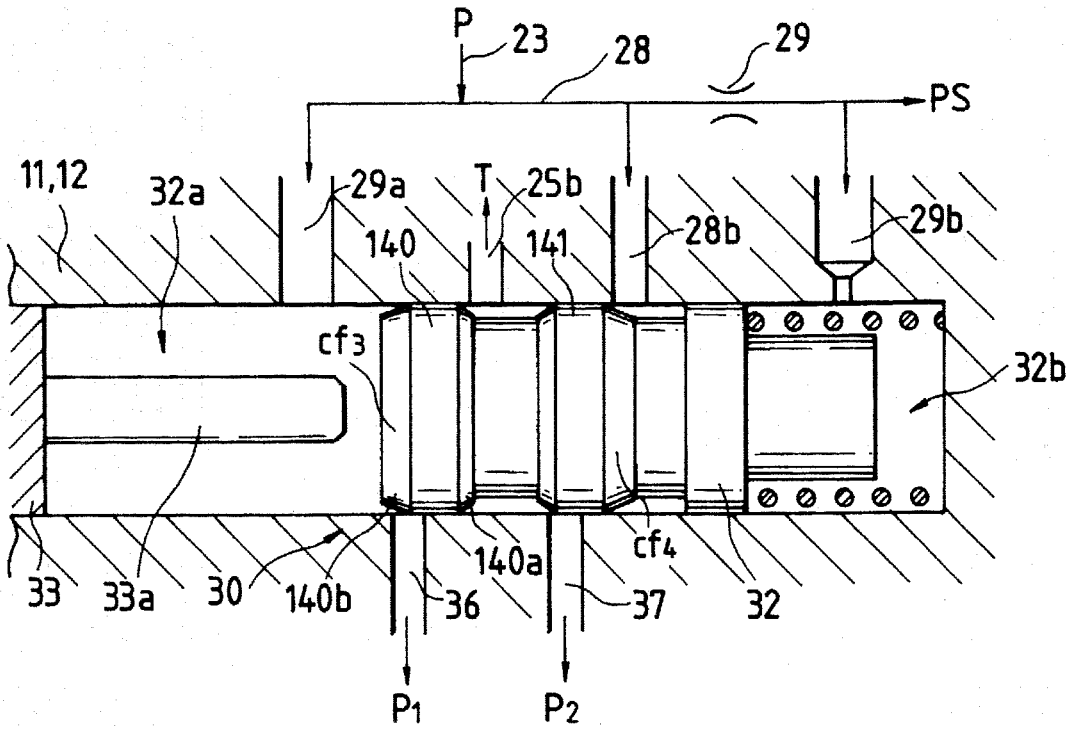
FIG. 19 is a schematic, sectional view showing the major parts of the fifth embodiment in a state that a pump chamber is made minimum during the valve activation.

FIGS. 17 to 19 show a fifth embodiment of the present invention. The difference from the aforementioned fourth embodiment is that chamfers 140*b* and 141*b* on the lands 140 and 141 of the spool 32 define an area where both the conduit 36 and 37 respectively communicated with the hydraulic pressure chambers 34 and 35 are communicated with pump discharge side P, the area being provided at a location of the movable control area where the pulsing phenomenon is likely to occur during the valve activation.

Figure 20:
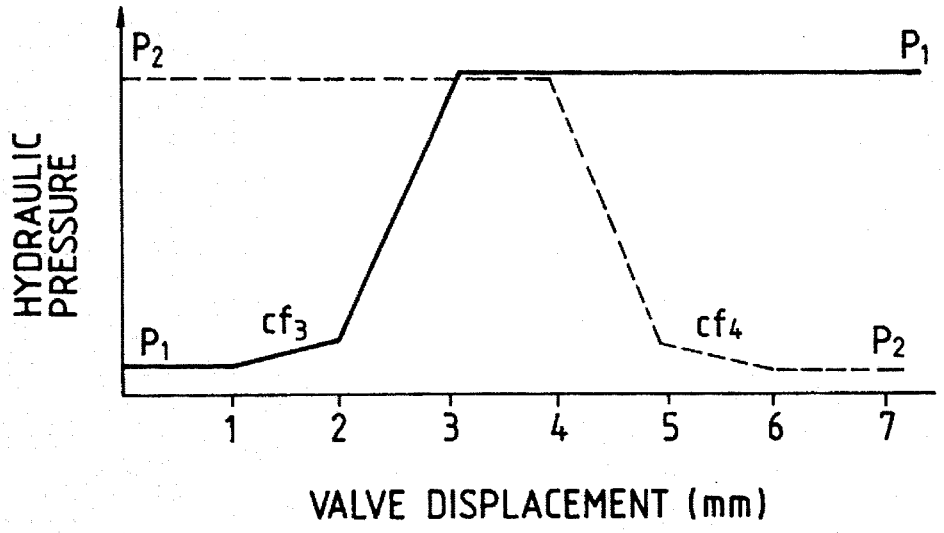
FIG. 20 shows a characteristic of a hydraulic pressure with respect to the valve deviation in accordance with the fifth embodiment.

According to this arrangement, the hydraulic pressure characteristic as shown in FIG. 20 can be obtained. The characteristic shown in FIG. 20 is slightly different from the that shown in FIG. 15, but, in this case also, shows the similar result that it is possible to prevent the valve oscillation and the pulsing phenomenon during the valve activation, regardless of the pressure increase of the pump discharge side in association with the load increase.

What is necessary for the forth and fifth embodiments is that when the hydraulic pressures applied to the hydraulic pressure chambers 34 and 35 are controlled through the spool-type switch valve 30, both of the chambers 34 and 35 are temporally communicated with one of the pump discharge side T and the pump intake side P so that the pressures in the chambers 34 and 35 are maintained at the same level, in order to prevent the pulsing phenomenon on the pump discharge side and to obtain a desired discharge flow quantity characteristic. In addition, In addition, the present invention should not be restricted to the arrangements described with reference to the first to fourth embodiments described with reference to FIGS. 1 to 20. Various modifications can be made to the components in shape, construction and arrangement. For example, the adapter ring 19 is provided to define the annular space through which the cam ring 17 is driven to be displaced in each of the embodiments, but it is possible to define such annular space between the pump body 11 and the cam ring 17 without the use of the adapter ring 19. Further, the chamfers 140*a* and 141*a* and/or the chamfers 140*b* and 141*b* are formed on the lands 140 and 141 in the forth and fifth embodiments in order to communicate both of the chambers 34 and 35 with one of the pump discharge side P and the pump intake side T, but notches may be provided in suitable locations in place of the chamfers. Also, the same effect can be achieved by modifying the positional and/or dimensional relationship between the lands 140, 141 and the conduits 36, 37. Furthermore, the vane type variable displacement pump of the invention can be applied not only to the power steering unit but also to other equipment or devices which utilize the pressurized fluid.

What is claimed is:

1. A variable displacement type pump, comprising:

a pump body;

a rotor having a plurality of vanes, rotatively arranged within said pump body;

a cam ring movably arranged around said rotor within said pump body for defining a variable pump chamber between said cam ring and said rotor and an annular chamber between said cam ring and said pump body;

biasing means for biasing said cam ring so as to make said pump chamber maximum in volume;

sealing means contacting with both said cam ring and said pump body for dividing said annular chamber into first and second hydraulic pressure chambers to which hydraulic pressure is applied to move and position said cam ring relative to said pump body against the biasing force of said biasing means to vary the volume of said pump chamber; and a switch valve for switching said hydraulic pressure between said first and second hydraulic pressure chambers in accordance with a quantity of fluid discharged from said pump chamber, wherein said switch valve is driven based on a pressure difference between upstream and downstream sides of an orifice provided at a pump discharge side of said pump, and wherein said switch valve thus driven communicates the pump discharge side and a pump suction side of said pump with the first and second pressure chambers to move said cam ring.

2. The pump according to claim 1, wherein said rotor is formed with slit grooves for extendably accommodating respective vanes therein, each of said slit grooves having a proximal portion which is fluidly communicated with said pump chamber so that proximal portions of each of said vanes receive substantially the same pressure as applied in said pump chamber.

3. The pump according to claim 1, further comprising:

a flow control valve for maintaining said quantity of fluid discharged from said pump chamber so as not to exceed a predetermined quantity, said flow control valve being prevented from being activated when said quantity of fluid discharged from said pump chamber is less than said predetermined quantity.

4. The pump according to claim 1, wherein said plurality of vanes are extendably accommodated in respective slit grooves extending radially in said rotor, each of said slit grooves having a distal portion located at said pump chamber and a proximal portion radially opposite from said distal portion, and wherein a plurality of arcuate grooves are formed in an inner wall of said pump body and radially located correspondingly to said proximal portion with respect to said rotor for fluidly communicating said proximal portion with one of a pump discharge side and a pump intake side in conjunction with rotation of said rotor.

5. A variable displacement type pump as recited in claim 1, wherein said cam ring is pivotally supported within said pump body.

6. A variable displacement type pump, comprising:

a pump body;

a rotor having a plurality of vanes, rotatively arranged within said pump body;

a cam ring movably arranged around said rotor within said pump body for defining a variable pump chamber between said cam ring and said rotor, and an annular chamber between said cam ring and said pump body;

biasing means for biasing said cam ring so as to make said variable pump chamber maximum in volume;

sealing means contacting with both said cam ring and said pump body for dividing said annular chamber into first and second hydraulic pressure chambers to which hydraulic pressure is applied to move and position said cam ring relative to said pump body against the biasing force of said biasing means to vary the volume of said pump chamber; and a switch valve for switching said hydraulic pressure between said first and second hydraulic pressure chambers in accordance with a quantity of fluid discharged from said pump chamber, wherein said switch valve is operable so that both said first and second hydraulic pressure chambers are simultaneously communicated with one of a pump intake side and a pump discharge side.

7. A variable displacement type pump which forces fluid to flow from a pump intake side to a pump discharge side, said pump comprising:

a pump body;

a rotor having a plurality of vanes, rotatively arranged in said pump body;

a cam ring movably arranged around said rotor within said pump body for defining a variable pump chamber between said cam ring and said rotor, wherein the fluid flows from the pump intake side to the pump discharge side through said pump chamber, said cam ring also defining an annular chamber between said cam ring and said pump body;

sealing means for dividing the annular chamber into first and second hydraulic pressure chambers to which hydraulic pressure is applied to move and position said cam ring relative to said pump body to vary the volume of said variable pump chamber;

a switch valve for switching hydraulic pressure between said first and second hydraulic pressure chambers in accordance with a quantity of fluid discharged from said variable pump chamber; and a flow quantity control valve for fail-safety, which is fluidly communicated with a conduit extending from said pump chamber to the pump discharge side, wherein said flow quantity control valve is activated when said pump chamber discharges the fluid at a predetermined quantity slightly higher than an allowable maximum quantity of said pump, wherein said switch valve is driven based on a pressure difference between upstream and downstream sides of an orifice provided at the pump discharge side of said pump, wherein said switch valve thus driven communicates the pump discharge side and the pump suction side with said first and second pressure chambers to move said cam ring, and wherein said flow quantity control valve is controlled based on the pressure difference between the upstream side and the downstream sides of said orifice.

* * * * *